United States Patent [19]

Antonov et al.

[11] 4,386,737

[45] Jun. 7, 1983

[54] FLAME GUNITING LANCE

[76] Inventors: Veniamin V. Antonov, ulitsa Ogloblina, 6, kv. 43; Evgeny D. Shtepa, ulitsa Artema, 76, kv. 35; Alexandr P. Krivenko, ulitsa Elevatornaya, 19, kv. 81; Adelaida L. Kurbatova, ulitsa Druzhkovskaya, 9, kv. 19; Ivan R. Vedkalov, ulitsa Universitetskaya, 2, kv. 25; Viktor M. Chervonenko, ulitsa Artema, 179, kv. 40; Anatoly A. Yarmal, bulvar Shkolny, 18, kv. 61, all of Donetsk; Semen A. Donskoi, ulitsa Baiseintovoi, 13, kv. 12, Temirtau; Vladimir A. Korotky, ulitsa 8 Marta, 54, Donetskaya oblast, Volodarsky raion, Kalchik; Jury I. Zhavoronkov, prospekt Lenina, 8, kv. 22; Vadim I. Germanov, 6 mikroraion, 29, kv. 34, both of Temirtau; Alexei S. Kornienko, prospekt Nakhimova 66, kv.22, Zhdanov; Pavel A. Kaduba, prospekt Mettallurgov, 47, kv. 75, Zhdanov; Anatoly A. Chvilev, bulvar Shevchenko, 247, kv. 95, Zhdanov; Edvin I. Gamalei, ulitsa Baiseitovoi, 23/1, kv. 11, Temirtau; Fedor E. Dolzhenkov, bulvar Pushkina, 27, kv. 29, Donetsk; Valentin A. Kulichenko, prospekt Lenina, 5, kv. 2, Temirtau; Pavel B. Maikher, Karagandinskoe shosse, 22, kv. 13, Temirtau; Oleg I. Tischenko, prospekt Lenina, 6/2, kv. 2, Timertau; Galia A. Atlasova, ulitsa Lesnaya, 8/12, kv. 13, Moscow, all of U.S.S.R.

[21] Appl. No.: 229,648

[22] PCT Filed: Feb. 1, 1980

[86] PCT No.: PCT/SU80/00017

§ 371 Date: Jan. 30, 1981

§ 102(e) Date: Jan. 29, 1981

[87] PCT Pub. No.: WO80/02738

PCT Pub. Date: Dec. 11, 1980

[30] Foreign Application Priority Data

May 30, 1979 [SU] U.S.S.R. ..... 2771814

[51] Int. Cl.[3] ..... B05B 1/24

[52] U.S. Cl. ..... 239/79; 239/132.3; 239/406; 239/424; 239/434.5; 239/566

[58] Field of Search ..... 239/79, 81, 85, 132.3, 239/132.5, 424–425, 434.5, 406, 566; 266/281

[56] References Cited

U.S. PATENT DOCUMENTS 1,617,166 2/1927 Schoop ..... 239/85

3,883,078 5/1975 Chemeris ..... 239/132.3 X

FOREIGN PATENT DOCUMENTS 245960 6/1969 U.S.S.R. ..... 239/132.3

*Primary Examiner*—Andres Kashnikow

*Attorney, Agent, or Firm*—McAulay, Fields, Fisher, Goldstein & Nissen

[57] ABSTRACT

A flame guniting lance comprises a water-cooled casing made up of pipes (1 and 2). Arranged concentrically inside the casing are pipes (4) for supplying a mixture of powdered refractory material and fuel, and pipes (3) for supplying oxygen. Each pipe (3 and 4) is respectively fitted with a nozzle (5) for supplying the mixture of refractory material and fuel, and a nozzle (6) for supplying oxygen, the nozzles being arranged in pairs and coaxially in each pair. The outlet cross-section of each nozzle (5) is positioned below the outlet cross-section of each nozzle (6) within a distance of 1 to 5 times the inside diameter of the nozzle (5). The walls of at least one of each pair of the nozzles (5 or 6) are partly or completely other than cylindrical in shape.

10 Claims, 12 Drawing Figures

FLAME GUNITING LANCE

FIELD OF THE INVENTION

The present invention relates to hot patching technique, and more particularly, to lances for flame spraying or guniting of metallurgical unit lining.

BACKGROUND OF THE INVENTION

The requirements upon the quality of gunite built-up on metallurgical unit linings have grown to be more stringent.

There is known a flame guniting lance (German Pat. No. 2,200,667, issued on May 13, 1976) which consists of a water-cooled casing formed with ducts for supplying a powdered refractory material mixed with fuel and for admitting oxygen, whereby the refractory material, heated to a plastifying state in a high-temperature flame, is deposited on the lining surface. The water-cooled casing and the ducts for supplying the powdered refractory material mixed with the fuel and oxygen are bent through an angle of 15° to 30° with respect to the plane perpendicular to the axis of a nozzle which situated at the end face of the ducts, is directed at the right angle thereto. This constructional arrangement ensures good adhesion of the refractory material to the surface of a metallurgical unit lining.

However, the practical application of this lance for flame guniting involves problems. The sole nozzle adversely affects operating efficiency of the lance, the flame spraying operation being time consuming.

In addition, the curved shape of the lance complicates its manufacture and hinders the manipulations necessary to carry out while introducing the lance into, and pulling it out of, a metallurgical unit.

It should also be noted that the curved-shaped ducts for supplying the mixture of the powdered refractory material and fuel are subject to heavy abrasive wear, this substantially reducing the service life of the lance.

It should be noted that the powdered refractory material, fuel and oxygen are intermixed only after they exit from the respective nozzles. Since the refractory-fuel mixture and oxygen are supplied in parallel jets, their intermixing proceeds at a very slow rate, with the flame extending over a considerable distance from the nozzle. As the water-cooled casing and the concentric ducts formed therein are made curved in shape, the flame is directed tangentially relative to the surface of a metallurgical unit lining with the effect that the refractory material particles lack sufficient force of adhesion to ensure their reliable sticking to the lining. As a result, a considerable amount of the finer fractions of the powdered refractory material are entrained by the outgoing gases.

Another known lance for flame guniting (Metallurgy Journal No. 12, p.p. 25–26, Metallurgia Publishers, Moscow, 1977) consists of a water-cooled casing formed with concentrically arranged ducts for supplying a mixture of a refractory material and a fuel and for supplying oxygen. The powdered refractory material fuel mixture and oxygen are injected through several nozzles (for example, five) perpendicularly to the surface of a metallurgical unit lining. The lance of this type is simple in construction and reliable in operation owing to the fact that the ducts and the water-cooled casing are not curved. Projecting the flame at a right angle to the metallurgical unit lining makes it possible to slightly improve the quality of the refractory coat.

Despite certain advantages of the above lance over the single-nozzle curved lance, it still holds no answer to the problem of enhancing the degree of utilization of the refractory material deposited upon a lining and thereby producing high-quality refractory coat.

The refractory material-fuel mixture and oxygen are supplied in this type of lance in parallel jets, with the effect that mixing is very slow. As a result, the refractory material-fuel mixture and oxygen are intermixed to be ignited immediately before impinging upon the lining of a metallurgical unit. The fuel combustion begins in the zone of flame impingement and continues as the flame moves along the lining. As a result, a part of the refractory material is not heated to a plastifying state and thus fails to form a strong bond with the lining. This, in turn leads to a certain amount of the refractory material carried out of the metallurgical unit with combustion gases.

DISCLOSURE OF THE INVENTION

It is therefore an object of the invention to obviate the above disadvantages.

The invention has as its aim the provision of a lance for flame guniting of metallurgical unit linings, having nozzles thereof arranged so as to allow improvement in the quality of gunite deposited on a metallurgical unit lining, to lower the amount of the refractory material carried away with the outgoing gases, to reduce guniting time and to raise the degree of utilization of the refractory material, fuel and oxygen.

This aim is attained in a flame guniting lance comprising a water-cooled casing with concentrically arranged internal ducts for supplying a mixture of powdered refractory material and pulverized fuel and for supplying oxygen, outlets of the ducts carrying nozzles for delivering the refractory material-fuel mixture and for delivering oxygen, wherein, according to the invention, the nozzles for delivering the refractory material-fuel mixture and the nozzles for delivering oxygen are arranged in pairs along the ducts and coaxially in each pair, the end face of each nozzle for delivering the refractory material-fuel mixture being placed underneath the end face of each respective nozzle for delivering oxygen at a distance of 1 to 5 times the inside diameter of the nozzle for delivering the refractory material-fuel mixture, at least one of each pair of the nozzles having fully or partly a shape other than cylindrical.

This structural arrangement of the lance nozzles makes it possible to provide a directed flow of the refractory material, fuel and oxygen to be utilized to a higher possible degree, and permits the zone where the fuel burns and refractory material particles heat to a required temperature to be located in the space between the lance and the metallurgical lining surface, this in the final analysis improving the quality of gunite deposited on the metallurgical unit lining and reducing guniting time. The flame guniting lance according to the invention is simple in construction and reliable in operation.

In addition, with the nozzles of the flame guniting lance according to the invention it becomes possible to improve the intermixing of the refractory material-fuel mixture and oxygen inside the oxygen nozzle. The mixing is then more intensive than that induced by parallel jets. This, in turn, causes the fuel to ignite in direct proximity to the outlet from which issues the mixture of the refractory material and fuel, this improving the quality of the deposited gunite, lowering the amount of the refractory material carried away with the outgoing gases, and enhancing the utilization of the refractory material, fuel and oxygen.

Furthermore, the construction of the lance nozzles according to the invention makes it possible to intensify the intermixing of the fuel, oxygen and refractory material, to speed up ignition, to shorten the zone where the fuel is burned and the refractory material particles are heated in the flame through suction of high-temperature gases from the converter space or through the intensified mixing of the refractory material-fuel mixture and oxygen. This draws the boundary of the fuel ignition nearer the nozzle for delivering the mixture of the refractory material and fuel. Higher rate combustion allows for the refractory material particles to be heated to a plastifying state directly inside the flame before they hit the surface of a metallurgical unit lining. The particles of the refractory material strike the metallurgical unit lining when already in plastic state, owing to which the utilization of the refractory material increases because of a lesser entrainment of the refractory material with the outgoing gases. Another advantage is that no other but heat-softened particles of the refractory material are projected upon the lining, this significantly improving the quality of the protective coat.

In the flame guniting lance, it is preferable that each nozzle for delivering oxygen be elliptic in cross section.

This aids in accelerating the ignition of the fuel in two opposite areas of the flame, situated along the small axis of the ellipse.

It is desirable to provide transversal grooves on the external surface of each nozzle for delivering the powdered mixture of the refractory material and fuel; the grooves are preferably formed to have a depth equal to 0.8 to 1.2 times the minimum width of the gap between the nozzle for delivering the refractory material-fuel mixture and the nozzle for delivering oxygen.

The grooves slow down the flow of oxygen through the narrow areas of the space between the nozzles and reduce the distance on which the fuel and oxygen mix together and the fuel ignites.

Favourable to the operation of the flame guniting lance is the provision of longitudinal internal and external grooves on each nozzle for delivering the mixture of the refractory material and fuel; the internal and the external grooves are to alternate, to be wedge-shaped and to flare longitudinally at an angle of 5° to 20° to the central axis of the nozzle.

This improves the mixing of the components and intensifies the combustion and the heat exchange in the flame, so improving the quality of the coat of the refractory material and minimizing the entrainment of the refractory material from inside the metallurgical unit. This type of nozzles can be advantageously employed in guniting of large-size metallurgical units where a long-flame guniting range (reach) is required.

Each nozzle for delivering the powdered mixture of the refractory material and fuel in the flame guniting lance can be advantageously provided with slots having a width equal to between 0.1 and 0.3 times the width of the nozzle and a height not less than one inside diameter of the nozzle, the slots being oriented tangentially to the internal surface of the nozzle.

This permits even more intensive intermixing of the refractory material, fuel and oxygen in proportions necessary for ensuring the combustion directly at the end face of the nozzle for delivering the powdered mixture of the refractory material and fuel. In addition, this constructional arrangement shortens the zone of combustion, increases the liberation of heat per unit volume of the flame and so contributes to better guniting of linings in small-size metallurgical units and that of downwardly looking surfaces, such as, roofs of steel-making units.

Another desideratum in the flame guniting lance is that each nozzle for delivering oxygen be divided into two parts; the bottom one of these is formed as ellipse in cross section with two openings situated in diametrically opposite quadrants and directed tangentially to the nozzle for delivering the powdered mixture of the refractory material and fuel.

Such an arrangement intensifies the mixing of oxygen, fuel and refractory material, causes the fuel to ignite in close proximity to the end face of the nozzle for delivering the mixture of the refractory material and fuel, provides a short flame, steps up the process of heating, distributes more uniformly the components across the flame, this improving the quality of the gunited lining and decreasing the entrainment of the refractory material out of the metallurgical unit.

Another improvement in the flame guniting lance is to mount a conical shell inside each nozzle for delivering oxygen at some distance from its end, with the small base of the shell facing inwards.

The purpose of the conical shell is to further intensify the mixing of the refractory material, fuel and oxygen in proportions necessary for igniting the fuel directly after it issues from the conical shell outlet, to provide a means to adjust over a wide range both the expansion angle and the smoothness of the flame and so improve guniting uniformity and make it possible to gunite small-size metallurgical units.

The construction of the flame guniting lance can further be improved by mounting a wedge-shaped insert close to the nozzle for delivering the powdered mixture of the refractory material and fuel and near each hole in the bottom part of the nozzle for delivering oxygen in a manner that one of the surfaces of the insert continues the inside surface of the respective opening.

This construction ensures more effective rotation of the oxygen stream and improves the mixing of the fuel, oxygen and refractory material, shortens the fuel combustion zone and improves the heating of the refractory material particles in the flame.

BRIEF DESCRIPTION OF THE DRAWINGS

The invention will now be described, by way of example only, with reference to the accompanying drawings, in which.

BEST MODE OF CARRYING OUT THE INVENTION

Figure 1:
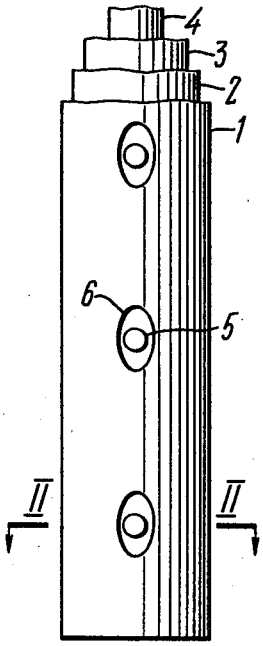
FIG. 1 illustrates schematically that part of a lance according to the invention where nozzle outlets are situated.

A flame guniting lance (FIGS. 1, 2 and 3) comprises a water-cooled casing formed with pipes 1 and 2, wherein are concentrically arranged pipes 3 and 4 for supplying respectively oxygen and a mixture of a powdered refractory material and fuel. An annular duct between the pipes 1 and 2 serves to supply water. An annular duct between the pipes 2 and 3 is intended to discharge cooling water. Oxygen is supplied through an annular duct between the pipes 3 and 4, and the mixture of the refractory material and the fuel, through the central pipe 4. Nozzles 5 for delivering the powdered mixture of the refractory material and fuel are mounted on the pipe 4. Nozzles 6 for delivering oxygen are mounted on the pipe 3 concentrically with the nozzles 5. The end of each nozzle 5 for delivering the powdered mixture of the refractory material and fuel is situated underneath the end of each respective nozzle 6 for delivering oxygen at a distance L equal to 2.5 times the inside diameter d of the nozzle 5 for delivering the powdered mixture of the refractory material and fuel. The distance L may vary from 1 to 5 times the inside diameter d of the nozzle 5. Should this distance become smaller than 1 d the effect from the interaction of the jets in the space between the ends of the nozzles 5 and 6 will be negligible; by contrast, should this distance increase to more than 5 d, the nozzles 6 may be abraded by the refractory material entrained into the peripheral zones of the jet before it issues from the nozzle 6. The nozzles 6 for delivering oxygen may have any cross sectional shape other than cylindrical. As shown on FIGS. 1, 2 and 3, the nozzles 6 for delivering oxygen are elliptic in cross section. The major axis of the elliptic nozzle 6 is aligned with that of the pipe 3. The nozzle 5 for delivering the powdered mixture of the refractory material and fuel is provided on the outside with grooves 7 of a depth h equal to 1.0 times the minimum width of the gap between the nozzle 5 and the nozzle 6. In practice, the depth h of the grooves 7 can range between 0.8 and 1.2 times the minimum width of the gap between the nozzle 5 and the nozzle 6. If the depth h of the grooves 7 is less than 0.8 times the minimum width of the gap between the nozzle 5 and the nozzle 6 they will fail to slow down effectively the oxygen jet in the narrow cross section, whereas the depth h of the grooves 7 of more than 1.2 times the minimum width of the gap between the nozzle 5 and the nozzle 6 will considerably slow down the flow of oxygen.

Figure 4:
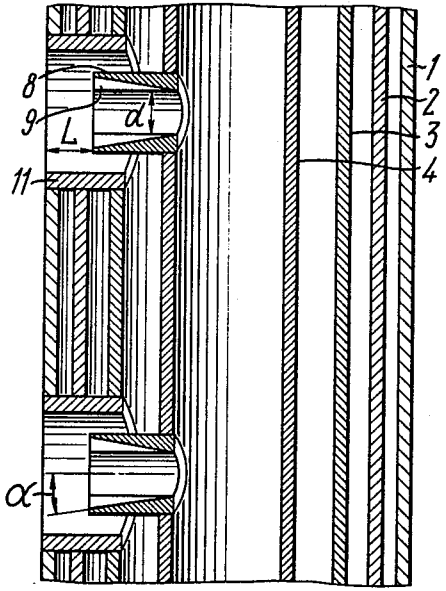
FIG. 4 is a longitudinal section of the zone of outlets of nozzles having grooves set obliquely relative to the central axis of said nozzles, according to the invention.
Figure 5:
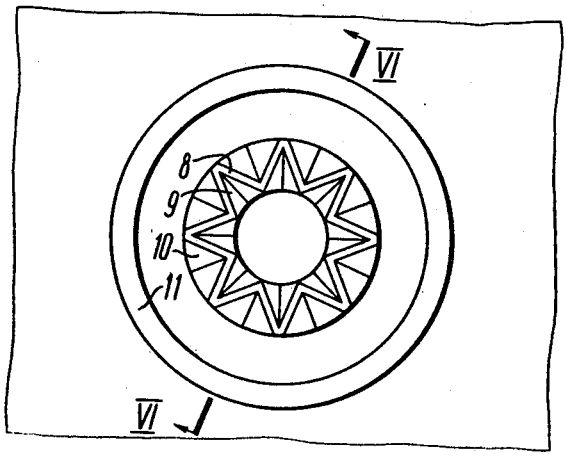
FIG. 5 is a view of same taken in plan upon the end faces of nozzles.
Figure 6:
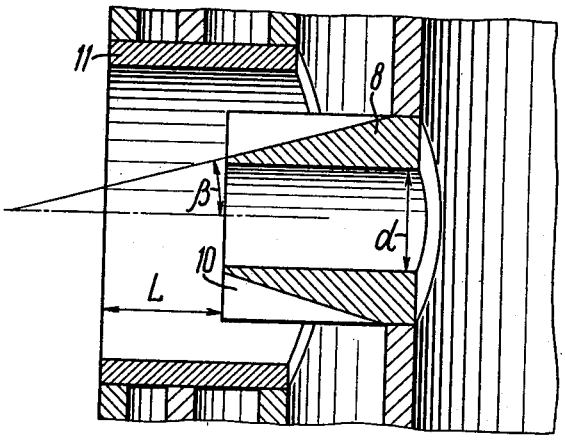
FIG. 6 is a cross section through VI—VI on FIG. 5.

FIGS. 4, 5 and 6 show nozzles 8 for delivering the powdered mixture of the refractory material and fuel, which are provided alternately with internal 9 (FIG. 5) and external 10 grooves, wedge-shaped in cross section, flared longitudinally toward the end of the nozzle 8 and set at an angle respectively $\alpha$ and $\beta$ of 18° relative to the central axis thereof. The angles $\alpha$ and $\beta$ of the wedge-shaped grooves may range between 5° and 25° to suit the dimensions of a metallurgical unit involved, the thermal and physical properties and the size composition of the refractory material the physiochemical properties and the size composition of the fuel. With the grooves sloped at angle $\alpha$ and $\beta$ smaller than 5°, the mutual penetration of the jets of components will be negligible, whereas with angles $\alpha$ and $\beta$ larger than 25°, the wedge-shaped jets of one component may penetrate that of the other component and fall out of the flame. A nozzle 11 for delivering oxygen is cylindrical in this constructional embodiment. The end face of the nozzle 8 for delivering the powdered mixture of the refractory material and fuel is situated inside the nozzle 11 for delivering oxygen at a distance L equal to 2.5 times the inside diameter of the nozzle 8 from the end face thereof.

Figure 7:
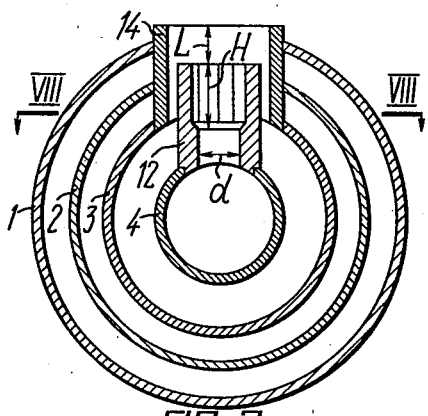
FIG. 7 shows a cross section of a flame guniting lance wherein nozzles are provided with slits, according to the invention.
Figure 9:
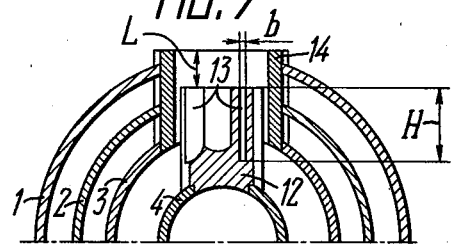
FIG. 9 is a cross section through IX—IX on FIG. 8.
Figure 8:
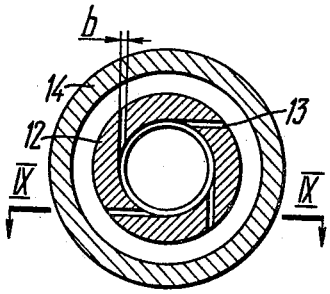
FIG. 8 is a cross section through VIII—VIII on FIG. 7.

FIGS. 7, 8 and 9 show the lance construction wherein a nozzle 12 for delivering the powdered mixture of the refractory material and fuel is provided with longitudinal slits 13, whereas a nozzle 14 for delivering oxygen is cylindrical in cross section. The slits 13 have a width b equal to 0.2 time the inside diameter d of the nozzle 12 for delivering the powdered mixture of the refractory material and fuel and a height H equal to two inside diameters d of the nozzle 12 for delivering the powdered mixture of the refractory material and fuel. The slits 13 are tangential to the internal surface of the nozzle 12. The width of the slits 13 may vary in the range between 0.1 to 0.3 time the inside diameter d of the nozzle 13 for delivering the powdered mixture of the refractory material and fuel depending on the required degree of rotation of the components in the jets. Making the slits 13 of a width smaller than 0.1 time the inside diameter d of the nozzle 12 for delivering the powdered mixture of the refractory material and fuel serves no purpose, as then the amount of oxygen entering the nozzle 12 for delivering the powdered mixture of the refractory material and of fuel will be insufficient and the resultant rotating motion of the jet too weak. An increase in the width of the slits 13 over 0.3 times the inside diameter d of the nozzle 12 for delivering the powdered mixture of the refractory material and fuel may lead to a considerable increase of the pressure inside the nozzle 12 for delivering the mixture of the refractory material and fuel and thus obstruct the outflow of the powdered mixture of the refractory material and fuel. The optimum width of the slits 13 is 0.2 time the inside diameter d of the nozzle 12 for delivering the powdered mixture of the refractory material and fuel.

The optimum height H of the slits 13, shown on FIG. 9, equals two inside diameters d of the nozzle 12 for delivering the mixture of the refractory material and fuel. If the height H of the slits 13 is smaller than one inside diameter d of the nozzle 12 for delivering the mixture of the refractory material and fuel, the amount of oxygen entering the nozzle 12 will be insufficient, whereas the desirable rotation of the jet will be equally inadequate. With the height H of the slits 13 greater than five inside diameters d of the nozzle 12 for delivering the powdered mixture of the refractory material and fuel, the flow of oxygen inside the nozzle 12 will grow excessively, thereby increasing the resistance of the ducts to the flow of the powdered mixture of the refractory material and fuel and thus reducing the rate of flow thereof.

Figure 10:
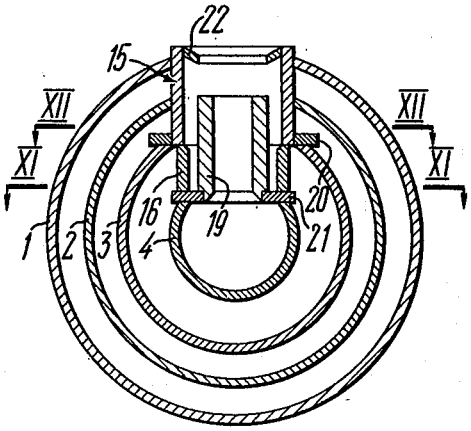
FIG. 10 shows a cross section of a lance wherein nozzles are divided into two parts, according to the invention.
Figure 11:
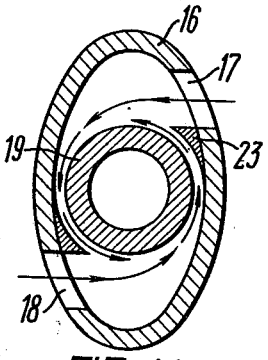
FIG. 11 is a cross section through XI—XI on FIG. 10.
Figure 12:
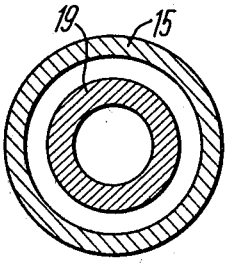
FIG. 12 is a cross section through XIII—XIII on FIG. 10.

FIGS. 10, 11 and 12 present the constructional arrangement of a lance wherein each nozzle 15 for delivering oxygen is divided into two parts, the bottom part 16 of which is elliptic in cross section and provided with two openings 17 and 18 (FIG. 11) situated in diametrically opposite quadrants and oriented tangentially to the nozzle 19 for delivering the powdered mixture of the refractory material and fuel.

To simplify the constructional arrangement, the bottom part 16 of the nozzle may be mounted with the aid of plates 20 and 21.

Each nozzle 15 for delivering oxygen is provided with a conical shell 22 mounted therein at some distance from the end thereof, with the small base of the conical shell facing inwards. Wedge-shaped inserts 23 are mounted near each nozzle 19 for delivering the powdered mixture of the refractory material and fuel and near each opening 17 and 18 in the bottom part 16 of the nozzle 15 for delivering oxygen so that one of the surfaces of the wedge-shaped inserts 23 continues the internal surface of the respective opening 17 or 18.

As the bottom part 16 of the nozzle 15 for delivering oxygen is elliptic and carries two openings 17 and 18 situated in diametrically opposite quadrants, the oxygen flow entering the gap between the nozzle 15 for delivering oxygen and a nozzle 19 for delivering the powdered mixture of the refractory material and fuel is given a rotating motion about the nozzle 19. The inserts 23 prevent oxygen issuing from the opening 17 and 18 to move counter to the flow of oxygen swirling about the nozzle 19, thus enhancing the vortical character of the flow of oxygen about the nozzle 19 for delivering the powdered mixture of the refractory material and fuel.

The flame guniting lance operates in the manner below.

Prior to the guniting operation, water for cooling the lance is supplied, and the flame guniting lance is pushed inside a metallurgical unit to be gunited. The lance is positioned so that the nozzles 5 and 6 thereof (FIGS. 1, 2, 3) are directed at the area of the metallurgical unit lining to be repaired (not shown on the drawing). A powdered mixture of the refractory material and fuel is fed through the central pipe 4 and the nozzles 5. At the start of guniting, the rate of flow of the powdered mixture of the refractory material and fuel is set at 20 to 25% of the nominal value. Oxygen is then supplied through the annular duct between the pipes 3 and 4 and through the annular ducts between the nozzles 5 and 6, the oxygen flow rate being adjusted to as to ensure complete combustion of the fuel supplied as a component of the powdered mixture together with the refractory material through the nozzle 5. Once the fuel ignites, the flow rates of oxygen and of the powdered mixture of the refractory material and fuel are adjusted as required, and the refractory material is applied upon the areas of the metallurgical unit lining to be repaired by an appropriate motion of the flame jet. The powdered mixture of the refractory material and fuel issues as central asymmetrical jets, whereas oxygen flows out of the annular ducts between the nozzles 5 and 6 as annular jets concentric with the central jets of the refractory material and fuel. As the end faces of the nozzles 5 are situated inside the nozzles 6 at a distance equal to L, the jets interact within the space defined by the walls of the nozzles 5 and 6, this improving the mixing of the components.

Figure 2:
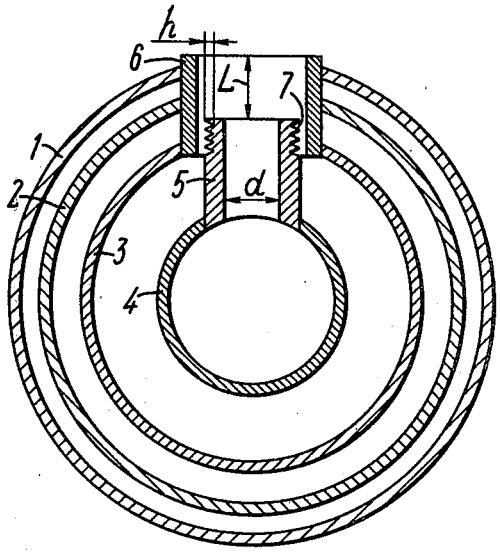
FIG. 2 is the cross section through II—II of FIG. 1.
Figure 3:
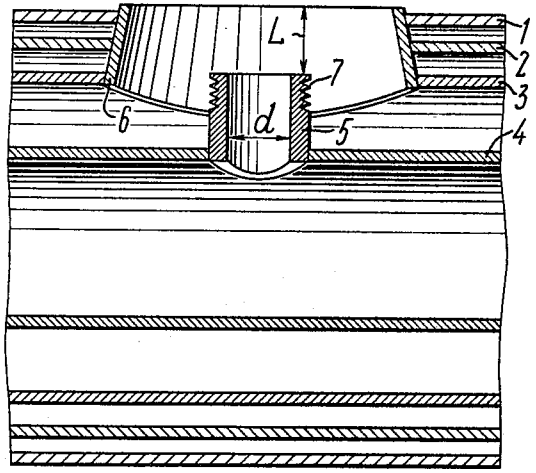
FIG. 3 is a longitudinal section through the plane of the major axis of the elliptic oxygen supply nozzle of the lance of FIG. 1.

When a flame guniting lance with the nozzles shown on FIGS. 1, 2 and 3 is used, the jet of oxygen is elliptic in cross section, and the jet of the refractory material and fuel is in the centre thereof. The thickness of the oxygen jet is at a minimum in the plane of the minor axis of the ellipse. The effect of the thinner oxygen jet is that it shortens the distance where the fuel and oxygen mix together in a proportion necessary for ignition and sucks high-temperature gases from the metallurgical unit space. The grooves 7 on the external surface of the nozzles 5 slow down the flow of oxygen in these two areas, thereby facilitating the ignition of the fuel.

The fuel ignites on the two sides of the now combined jet of oxygen and of the powdered mixture of the refractory material and fuel, which is elliptic in cross section. The combustion then combines in the direction of the flame flow in the area between the two-phase jet of the refractory material and fuel and the annular jet of oxygen. The jet, elliptic at the start, now becomes round. As the cross sectional shape of the jet changes, the components mix intensively, the combustion processes in the flame enhancing the mixing. The particles of the refractory material heat rapidly in the high-temperature flame to a plastifying state and thus impinge upon the metallurgical unit lining to bond strongly therewith. The service life of this coat, as compared to that obtained from a central round jet of solid components and an annular jet of oxygen, increases from 4 to 5 heats, i.e. roughly by 20%.

A lance with nozzles of this design can advantageously be used for guniting linings of metallurgical units of medium size, where the distance between the ends of the nozzles and the lining surface is 2 to 3 m.

When the components are supplied through the nozzles of FIGS. 4, 5 and 6, the powdered mixture of the refractory material is delivered through the nozzle 8 which is round at its inlet, but changes to a star-like shape at its outlet, the cross sectional areas of the wedge-shaped ducts increasing in the direction towards the outlet. Oxygen in this case is supplied through the annular gap between the nozzles 8 and 11, which is provided at its outlet with wedge-shaped grooves, the cross sectional area thereof expanding toward the outlet.

The two-phase jet of fuel and refractory material issuing through the jet 8 expands transversely because of the increase in the cross sectional area of the grooves, this expansion being narrow-directional in character. Oxygen flowing through the annular gap also expands because of the increase in the cross sectional area of the external wedge-shaped grooves in the direction toward the outlet. At the outlet from the annular gap, oxygen flowing through the wedge-shaped grooves penetrates at the given angle the two-phase jet of the refractory material and fuel, which flows through the internal wedge-shaped grooves of the nozzle 8; some of the two-phase jet, in turn, penetrating the oxygen jet so ensuring intensive mixing of the components, a part of the cross sectional area of the central jet being filled with oxygen and part of the refractory material and the fuel being displaced into the peripheral area of the jet. The contact of the fuel with the high-temperature gases of the working space of the metallurgical unit results in the ignition and rapid combustion thereof. The refractory material particles are heated in the high-temperature flame to a plastifying state and impinge upon the metallurgical unit lining at a velocity sufficient to form a strong coat. The service life of this coat is by 20% higher than that of a coat formed with the aid of nozzles supplying the components in parallel jets.

The nozzles of the design shown in FIGS. 4, 5 and 6 are most advantageous for guniting large metallurgical units where the distance between the lance and the lining surface is 3 to 4 m.

With nozzles designed as shown in FIGS. 7, 8 and 9, the powdered mixture of the refractory material and fuel is supplied through the central round nozzle 12, and oxygen, through the annular gap between the nozzle 12 for delivering the powdered mixture of the refractory material and fuel and of the nozzle 14 for delivering oxygen. A feature of this design is that a part of the total amount of oxygen is supplied into the duct for delivering the mixture of the refractory material and fuel through slits 13 in the walls of the nozzle 12 for delivering the mixture of the refractory material and fuel before this mixture leaves the nozzle. The injection of a part of oxygen into the powdered mixture of the refractory material and fuel substantially improves the mixing of the components. The jets of oxygen from the slits 13 have a velocity much higher than that of the two-phase jet of the solid components and impart a rotating motion to this powdered mixture of the refractory material and fuel.

The rotating motion ensures intensive intermixing of the fuel, refractory material and oxygen. After leaving the nozzle 12, the bodily rotating two-phase jet of the solid components moves forward, spreading sideways because of the centrifugal forces active therein and penetrating the annular jet of oxygen. The transversal motion of the components in the jets from the nozzles 12 and 14 results in a rapid mixing of oxygen, fuel and refractory material. The fuel ignites on contact with the high-temperature gases from the working space and burns near the nozzles 14 in a short high-temperature flame. The temperature, the velocity and the component concentration fields in the bodily rotating flame level off effectively, so that the particles of the refractory material having roughly equal temperature and velocity form on impact a better bond with the lining. The rotation of the flame about its own axis also allows a higher degree of penetration of particles into the metallurgical unit lining. The service life of this coat increases approximately by 20% as compared with the straight-on delivery of the components, thereby increasing by 10 to 20% the proportion of the refractory material actually bonded to the metallurgical unit lining.

The lances with the nozzles as shown in FIGS. 7, 8 and 9 can be used with good effect in hot patching of both large and relatively small metallurgical units. When guniting large units, a limited amount of oxygen is supplied to the central nozzle 12; this amount is increased when a smaller unit is gunited.

In the lance shown in FIGS. 10, 11 and 12, the powdered mixture of the refractory material and fuel is supplied through the central nozzle 19 as an asymmetrical two-phase jet, with oxygen being injected through the annular duct between the nozzle 19 and the nozzle 15 in the bodily rotating annular jet. Before issuing from the nozzles, the mixture of the refractory material, fuel and oxygen is passed through a narrow cross sectional area of the shell 22 where the components mix intensively. Oxygen delivered through the openings 17 and 18 as two jets and tangentially relative to the central nozzle 19 acquires a rotating motion. In the space between the end face of the central nozzle 19 and the shell 22, the bodily rotating jet of oxygen interacts with the two-phase jet of the powdered mixture of the refractory material and fuel and entrains it in rotating motion. On entering into the narrow section of the shell 22, oxygen and the powdered mixture of the refractory material and fuel mix intensively owing to the rotating motion of the components and to the penetration of oxygen into the jet of the refractory material-fuel mixture almost at a right angle to the flow direction of the latter. The mixture of the refractory material, fuel and oxygen issuing from the outlet of the shell 22 is well prepared for ignition. On contact with the high-temperature gases of the working space of a metallurgical unit, the fuel ignites and burns close to the outlet, the process coming to completion in a small volume.

This lance construction is best suitable for guniting small metallurgical units. In addition, the lance of this type can be used for flame spraying of downwardly sloped surfaces, such as roofs of open-hearth furnaces. The effectiveness of these lances in the guniting of roofs of open-hearth furnaces result in an increase of the service life thereof by 35%.

INDUSTRIAL APPLICABILITY

The lance according to the invention can be employed in repairs of metallurgical unit linings and in various other applications in the metallurgical and the machine-building industries.

However, a most effective field of application of the present invention is that in hot repairs of metallurgical units where the temperature of lining is above the ignition point of the fuel. For example, the lining of a converter can best be reconditioned directly after steel is tapped and slag is drained, so long as the lining temperature remains on the 1200° to 1400° C. range.

The lance according to the invention can be used in repairs of cylindrical metallurgical units, such as converters and steel-teeming ladles.

In addition, the flame guniting lance can be employed also for guniting flat surfaces, including those which slope downwards, as side walls and roofs of steelmaking, heating and other types of furnaces.

What is claimed is:

1. A flame guniting lance comprising inner and outer tubes forming a water-cooled casing inside which are concentrically arranged spaced pipes for supplying a powdered mixture of refractory material fuel and for supply oxygen;

said pipes having nozzles for delivering said powdered mixture, fuel and said oxygen;

said nozzles being arranged in pairs longitudinally and concentrically;

said nozzles for delivering said mixture having outlet cross-sections located underneath the outlet cross-sections of the corresponding nozzles for delivering oxygen at a distance equal to 1 to 5 times the inside diameter of said nozzle for delivering said mixture; at least one of said nozzles of each of said pairs being partly or completely other than cylindrical in cross section;

said nozzles for supplying oxygen having openings in the bottom part thereof.

2. A flame guniting lance is claimed in claim 1, wherein each said nozzle for delivering oxygen is elliptical in form.

3. A flame guniting lance as claimed in claim 2, wherein, the outside surface of each nozzle for delivering said mixture is provided with grooves for a depth equal to between 0.8 and 1.2 times the minimum width of the space between the nozzle for delivering said mixture and said nozzle for delivering oxygen.

4. A flame guniting lance as claimed in claim 1, wherein each nozzle for delivering said mixture is provided with alternatively arranged wedge-shaped, internal grooves and external grooves, flaring longitudinally toward the end of the said nozzle and make an angle of 5° to 25° relative to the central axis of the said nozzle.

5. A flame guniting lance as claimed in claim 1, wherein each nozzle for delivering said mixture is provided with longitudinal slits having a width ranging from 0.1 to 0.3 times the inside diameter of the said nozzle and a height of not less than one inside diameter of the said nozzle, said slits being oriented tangentially to the internal surface of the said nozzle for delivering the powdered mixture of the refractory material and fuel.

6. A flame guniting lance as claimed in claim 1, wherein each nozzle for delivering oxygen is divided in two parts, a bottom part of which is elliptical in cross section;

the walls thereof being provided with two openings situated in diametrically opposed quadrants and directed tangentially relative to said nozzle for delivering said mixture.

7. A flame guniting lance as claimed in claim 6, wherein a conical shell is mounted inside each oxygen-supplying nozzle remotely from the end thereof;

said shell having a small base facing inwards of said nozzle.

8. A flame guniting lance as claimed in claim 7, wherein close to one of said nozzles for delivering said mixture and near each said opening in the bottom part of said nozzle for supplying oxygen there is mounted a wedge-shaped insert arranged in a manner that one of the surfaces thereof continues the surface of a respective opening.

9. A flame guniting lance as claimed in claim 1, wherein the outlet cross-section of said nozzles for delivering said oxygen is star-shaped.

10. A flame guniting lance as claimed in claim 1, wherein one of said nozzles for delivering said mixture has longitudinal slits and another of said nozzles for delivering oxygen is cylindrical in cross-section.

* * * * *